US006422435B1

(12) United States Patent
Toaldo

(10) Patent No.: US 6,422,435 B1
(45) Date of Patent: Jul. 23, 2002

(54) SLIDE GATE FOR A CONTAINER CONTAINING MOLTEN METAL

(75) Inventor: Walter Toaldo, Zug (CH)

(73) Assignee: Stopinc Aktiengesellschaft, Hunenberg (CH)

( * ) Notice: Subject to any disclaimer, the term of this patent is extended or adjusted under 35 U.S.C. 154(b) by 0 days.

(21) Appl. No.: 09/744,563

(22) PCT Filed: Jul. 5, 1999

(86) PCT No.: PCT/CH99/00295

§ 371 (c)(1),
(2), (4) Date: Jan. 26, 2001

(87) PCT Pub. No.: WO00/06325

PCT Pub. Date: Feb. 10, 2000

(30) Foreign Application Priority Data

Jul. 26, 1998 (CH) ..... 1574/98

(51) Int. Cl.[7] ..... B22D 41/08
(52) U.S. Cl. ..... 222/600; 222/597
(58) Field of Search ..... 222/597, 600; 266/236

(56) References Cited

U.S. PATENT DOCUMENTS

| | | | | |
|---|---|---|---|---|
| 3,760,993 A | | 9/1973 | Meier | 222/600 |
| 4,660,749 A | | 4/1987 | Yokoi et al. | 222/600 |
| 4,848,604 A | | 7/1989 | Fricker | 222/600 |
| 5,141,139 A | * | 8/1992 | Kleeblatt | 222/600 |
| 5,421,563 A | * | 6/1995 | Holtermann et al. | 222/600 |
| 5,836,485 A | * | 11/1998 | Plattner et al. | 222/600 |

FOREIGN PATENT DOCUMENTS

| | | |
|---|---|---|
| CH | 639301 | 11/1983 |
| DE | 3532260 | 3/1986 |
| FR | 2090260 | 1/1972 |
| WO | 88/01211 | 2/1988 |

* cited by examiner

*Primary Examiner*—Scott Kastler
(74) *Attorney, Agent, or Firm*—Wenderoth, Lind & Ponack, L.L.P.

(57) ABSTRACT

A sliding gate valve (20) for a container containing molten metal has a housing portion (14) securable to the container and a slider unit (30) which is longitudinally movable with respect to the container. Respective refractory valve plates (22, 23) are insertable into the housing portion, and may be pressed against one another by spring elements (26). The refractory valve plates serve to open and close the valve (20). The slider unit (30) is mounted so as to be longitudinally movable on the housing portion by a plurality of mounting components (40) aligned perpendicular to the slider unit 30. The mounting components (40) are each secured to the housing portion (14) and on an opposite end have a guide which slides on a guide track (36) constructed on the slider unit (30). The mounting components (40) have a respective peg-shaped connecting element (25), a spring element (26) acting on the connecting element in the axial direction, and the guide supported on the connecting element (25).

26 Claims, 3 Drawing Sheets

SLIDE GATE FOR A CONTAINER CONTAINING MOLTEN METAL

BACKGROUND OF THE INVENTION

The invention relates to a sliding gate valve and to an associated slider unit.

In a known sliding gate valve disclosed in publication EP-A-0277146, a longitudinally slidable slider unit is provided which accommodates a refractory valve plate and which is constructed as a sliding carriage and has rollers on both sides to guide the slider unit longitudinally. In the installed state, the sliding carriage is longitudinally guided with its rollers on guide tracks on a frame which, for its part, is vertically movably mounted on a housing upper portion by a plurality of spring elements. The housing upper portion for its part is releasably secured to the outlet of the vessel containing the molten metal.

The slider unit can be released from the frame and from the housing upper portion, particularly for plate replacement, by virtue of the fact that it is movable into a position situated outside an open and closed position in which the guide tracks are lowered through a height which relaxes the spring elements. The frame provided with the guide tracks is massive as a result of its construction similar to a housing, and it therefore has a relatively complex construction and is consequently expensive to manufacture.

SUMMARY OF THE INVENTION

Against this background, the object of the present invention is to provide a sliding gate valve of the type referred to above which is of simple construction and may thus be manufactured more economically.

The object is solved by providing a gate valve in accordance with the invention. Specifically, the sliding gate valve in accordance with the invention can be provided with smaller dimensions, particularly with regard to its length and breadth, by comparison with the known valve described above with the same stroke and the same plate sizes. Furthermore, it may be manufactured more economically by virtue of the fact that the housing frame can be omitted.

The advantages of the known sliding gate valve, such as, for example, the automatic release and clamping of the slider unit from and to the housing portion, are, however, also applicable to the sliding gate valve in accordance with the invention.

A further substantial advantage of the sliding gate valve in accordance with the invention resides in the fact that, after release from the housing portion, the slider unit is pivotally mounted with a simply constructed hinge. Thus, the slider unit can pivot about an axis of rotation extending parallel to the direction of movement on one or the other outer side of the housing portion. The slider unit can thus be swung in a horizontal and non-vertical direction in the many installation conditions of the ladles which prevail.

Brief Description of the Drawings

Exemplary embodiments and further advantages of the invention will be explained in more detail with reference to the drawings, in which.

DETAILED DESCRIPTION OF THE INVENTION

Figure 1:
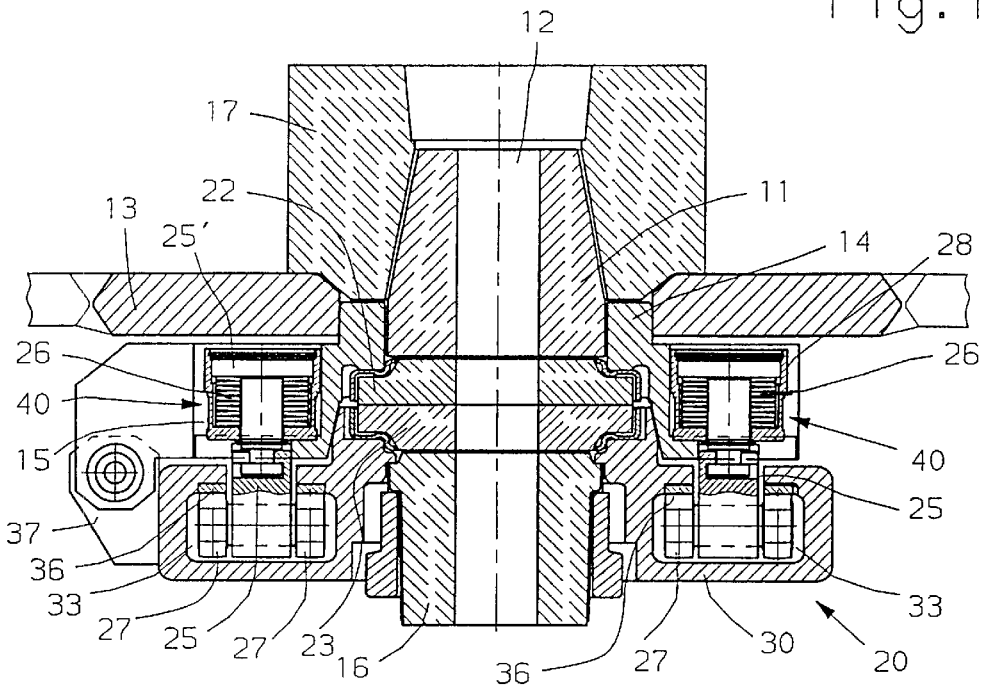
FIG. 1 is a sectional view of a sliding gate valve in accordance with the invention.

FIG. 1 shows a sliding gate valve 20 at the outlet of a container containing molten metal. This container is lined with refractory material, and only the outer steel shell 13 and a refractory nozzle brick 17 are shown. This container is, in particular, a ladle used in a continuous casting installation into which molten metal is introduced. A refractory sleeve 11 defines the outlet opening 12 of the container, and closely adjoins an upper, refractory valve plate 22 which is secured in a housing portion 14 of the sliding gate valve 20. A refractory valve plate 23, which is mounted in a longitudinally movable slider unit 30, is pressed against the upper plate 22 by spring elements 26. Adjoining the refractory valve plate 23 is a replaceable refractory outlet sleeve 16. The valve plate 23 serves to open and close the valve 20, for which purpose it is arranged to be slidable by a drive element together with the slider unit 30 holding it.

In accordance with the invention, the slider unit 30 is mounted on the housing portion 14 by a plurality of mounting components 40 extending perpendicular to the longitudinal axis of slider unit 30, and the slider unit 30 can move in a longitudinal direction. The mounting components 40 are secured to the housing portion 14 and have a guide located at an end opposite the end connected to the housing portion 14, and the guide slides on a respective guide track formed on the slider unit 30.

Figure 2:
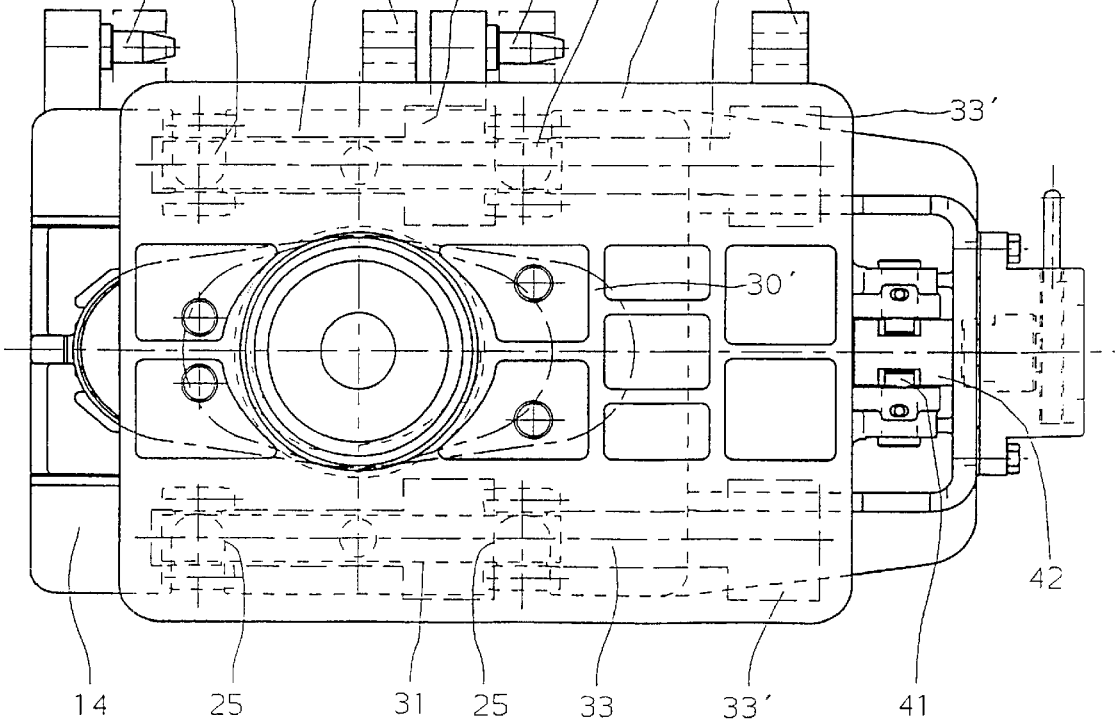
FIG. 2 is a view of the bottom of the sliding gate valve of FIG. 1.

Two mounting components 40 are conveniently provided on both sides of the valve plates 22, 23 (four total), and are arranged symmetrically with respect to the outlet opening 12 of the container (see FIG. 2). Each mounting components 40 has a peg-shaped connecting element 25 extending perpendicular to the longitudinal axis of the housing portion 14 and of the slider unit 30. These connecting elements 25 are mounted in the housing portion 14 so as to be movable in their axial direction. Acting on the upper head plates 25' of each connecting elements 25 is a respective spring element 26 constructed as a compression spring, and the spring is encapsulated in a sleeve 28. Rotatably mounted on the lower end of each connecting element 25 in pairs are two respective slide rollers 27, provided as the guides, on which the slider unit 30 is longitudinally guided. For this purpose, the slider unit has, on both sides of the valve plate 23 which is inserted into slider unit 30, a respective T groove-shaped recess 33 extending in the direction of movement of the slider unit, and two respective guide tracks 36 are formed in this recess. This symmetrical arrangement of the pairs of slide rollers with respect to the line of action of the spring force produced by the spring element 26 produces an optimal force transfer from the mounting components 40 to the slider unit 30 and subsequently to the plates 22, 23, which are to be pressed against one another.

As shown in FIG. 2, the T groove-shaped recesses 33, shown laterally in the slider unit 30 as hidden detail, are each provided in the center and at the end with diverging (larger) openings 33'. The openings 33' are constructed and dimensioned with respect to one another so that the connecting elements 25 are slidable into them together with the slide rollers 27, and so that the connecting elements 25 can be removed through them.

Figure 3:
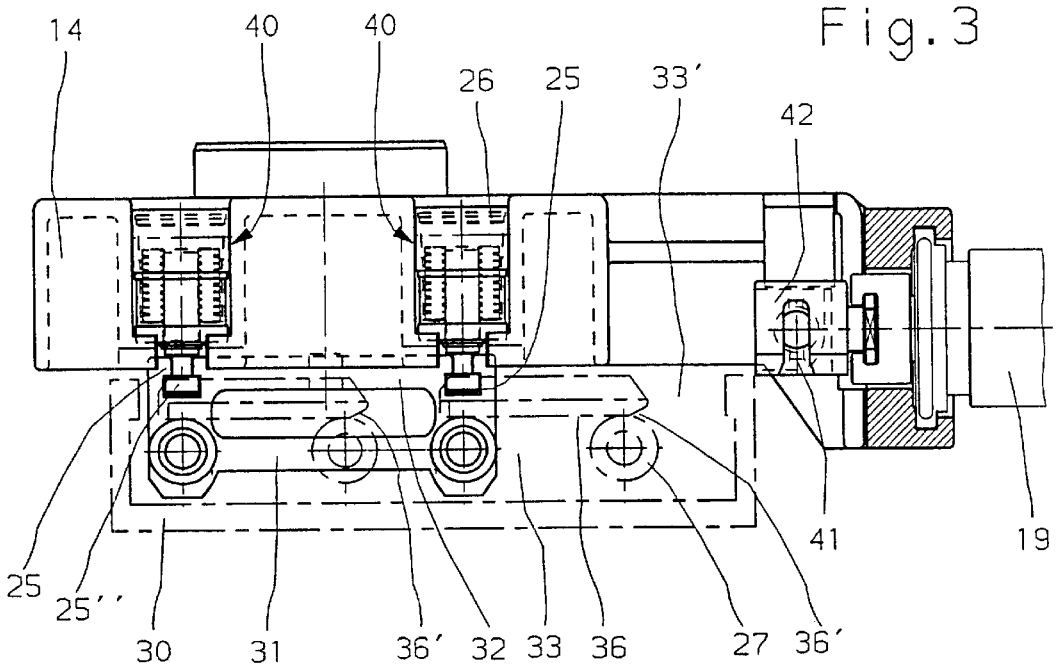
FIG. 3 is a side view of the sliding gate valve of FIG. 1, its slider unit being shown in chain-dotted lines.

FIG. 3 shows the guide tracks 36 which each have a respective ramp 36' at the end by the openings 33'. The height of each guide track 36 is such that the spring elements 26 are stressed to the operating pressure when the rollers 27 run onto them and are completely relaxed when released. In order to release the slider unit 30, the slider unit 30 is moved into a position situated outside the open and the closed positions of the valve 20 in which the slider unit is relieved of the spring pressure until its openings 33' are situated above the slide rollers 27 so that rollers 27 can pass through openings 33' and the slider unit 30 can be released. Hinge members 37 disposed laterally on the slider unit 30 move with their bores onto corresponding hinge pegs 38 on the housing portion 14, whereby the slider unit 30 can be swung outwardly. The slider unit 30 is coupled by means of claws 41 or the like to a push rod 42 of a drive element 19 constructed in the form of a hydraulic cylinder. As a further advantage, this claw coupling enables the slider unit 30 to be automatically released from the push rod 42.

The hinge 37, 38 could also be arranged on the other side of the slider unit 30 or on the shorter side remote from the drive. Accordingly, the slider unit can be swung out on one of the three sides, depending on the positioning of the valve on the ladle outlet. Since the direction of movement of the slider unit at the installation location extends in the vertical direction in many applications, the slider unit can be swung horizontally in the illustrated arrangement, which is associated with a small application of force.

The two mounting components 40 located on one side of the valve plate 22, 23 are reinforced by at least one connecting rod 31, 32 for stabilization against the bending forces which occur and they thus form a carriage shape. The two connecting rods 31, 32 provided in the present case are situated centrally in the recess 33. They have a breadth which corresponds approximately to that of the connecting elements 25 so that the connecting elements can be introduced into or removed from the recess 33. The connecting elements 25 are also divided into two sections and connected together by a tongue and groove connection 25" or the like. These connecting rods 31, 32 could also in principle be omitted. Sliding blocks could also be used instead of the slide rollers 27.

As a further advantage, these mounting components 40 can be removed laterally from the housing portion 14 as a unit, within the scope of the invention, when the slider unit 30 is swung out. For this purpose, appropriate openings 15 are present in the housing portion 14 through which the mounting components can be fittingly slid. The spring elements 26 can be rapidly removed through the openings 15 for the frequently necessary tests of their biasing force, and then reinserted.

Figure 4:
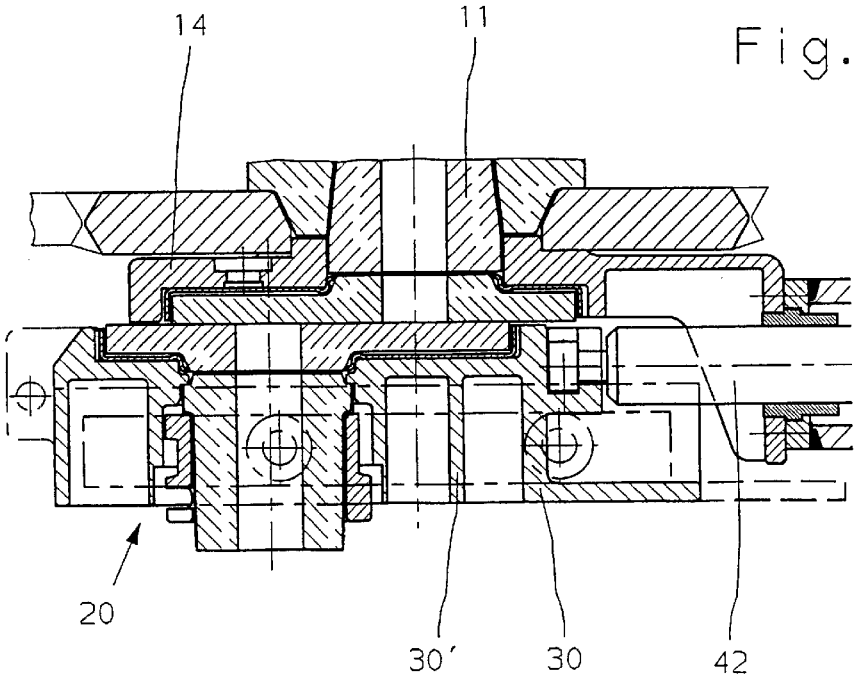
FIG. 4 is a longitudinal sectional view of the sliding gate valve of FIG. 1.

As shown in FIG. 4, transverse and longitudinal ribs 30' in the central part of the slider unit 30 serve to reinforce the slider unit 30 against distortion and torsional forces. The sliding gate valve 20 is otherwise illustrated in the closed position.

Figure 5:
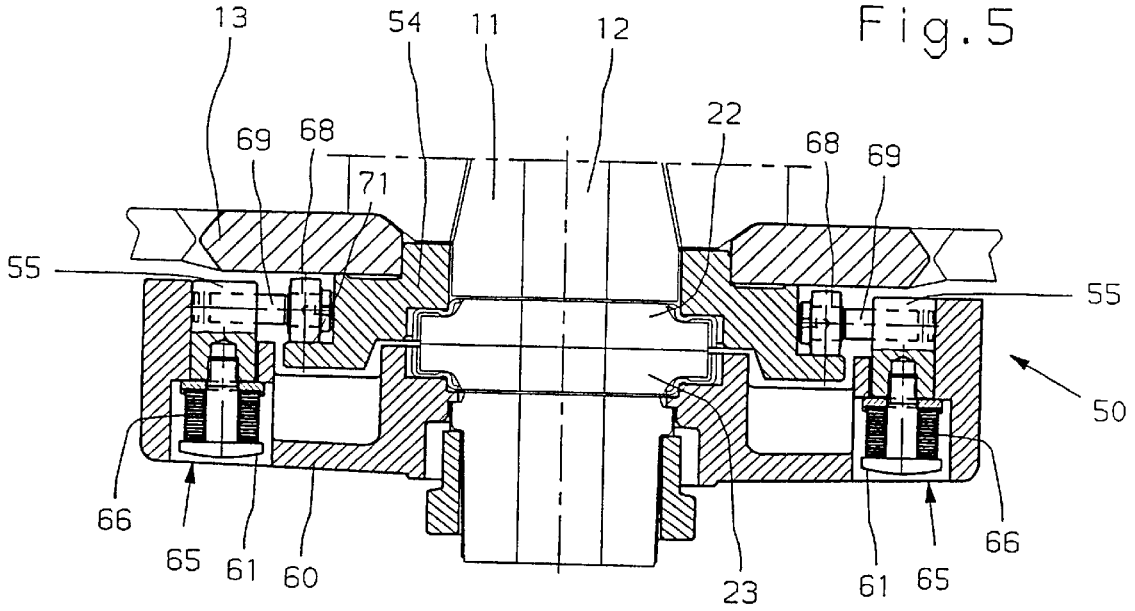
FIG. 5 is a sectional view of a modified construction of the sliding gate valve.

FIG. 5 shows a modified sliding gate valve 50 which is basically constructed in a manner similar to that of FIG. 1. Only the differences will therefore be discussed below in more detail. This sliding gate valve 50 again has a housing portion 54 which is secured to the container and in which a stationary, refractory valve plate 22 is contained. A significant difference from the valve 20 is that the mounting components 65 are not secured in the housing portion 54, but rather to the slider unit 60. The axially movable connecting elements 55 are mounted together with the spring elements 66, constituted by a plurality of plate springs, in a recess 61 in the slider unit 60. Associated with the connecting elements 55, of which there are advantageously again four, as a guide is a respective slide roller 68, which is rotatable on a horizontal shaft 69 and which slides on a guide track 71 on the housing portion 54 constructed in a manner analogous to that in FIG. 3. The two guide tracks 71 provided laterally on the housing portion extend in the direction of movement of the slider unit and are provided with ramps, which are not shown in detail and serve to load and unload the spring elements 66.

In the sliding gate valves 20, 50 in accordance with the invention discussed above, both the housing portion 14, 54 and the slider unit 30, 60 have a construction similar to a plate, and in the operational condition are arranged parallel and at a small distance from one another. These sliding gate valves 20, 50 can thus be maintained dimensionally as small as possible as a result of this construction in accordance with the invention, as regards the constructional height and also its length and breadth. The result of this is a more economical manufacture of the valves. This valve can be produced both in smaller dimensions for smaller ladles of up to 100 tons holding capacity, and also in larger dimensions for 300 ton ladles.

In principle, the necessary spring packet for urging the refractory plates against one another could be provided in a manner known per se between the sliding plate and the slider unit. The mounting components could accordingly be arranged non-movably in the housing portion or in the slider unit.

What is claimed is:

1. A sliding gate valve to be mounted to a container for containing molten metal, comprising:

a housing portion to be secured to the container;

a slider unit mounted to said housing portion and having guide tracks;

a first refractory valve plate and a second refractory valve plate inserted between said housing portion and said slider unit and operable to open and close the sliding gate valve; and a plurality of mounting components aligned perpendicular to said slider unit so as to mount said slider unit to said housing portion such that said slider unit is slidable with respect to said housing portion, each of said mounting components having:

a first end secured to said housing portion;

a spring element for pressing said first refractory valve plate and said second refractory valve plate against each other;

a second end opposite said first end; and a guide element on said second end for riding on a respective one of said guide tracks of said slider unit, said mounting components being arranged such that two guide elements are positioned on each of two opposite sides of said refractory valve plates;

wherein said slider unit is operable to be moved so as to position said guide elements at a location whereat a height of said guide tracks is lower than a height of a remaining portion of said guide tracks so as to relax said spring elements to allow release of said slider unit from said housing portion.

2. The sliding gate valve of claim 1, wherein said plurality of mounting components comprise two mounting components positioned on each of said two opposite sides of said refractory valve plates, each of said mounting components having an elongated connecting element extending perpendicular to a longitudinal axis of said housing portion and said sliding unit, said guide element being arranged on an end of said connecting element.

3. The sliding gate valve of claim 2, wherein each spring element comprises a compression spring element, each connecting element being mounted in said housing portion so as to be operable to move in an axial direction of said connecting element and so as to be biased by said spring elements so as to press said first refractory valve plate and said second refractory valve plate against each other.

4. The sliding gate valve of claim 2, wherein said two mounting components positioned on each of said two opposite sides of said refractory valve plates are arranged in said housing portion so as to be symmetrical with respect to an outlet opening of the container.

5. The sliding gate valve of claim 1, wherein said plurality of mounting components comprise two mounting components positioned on one side of said refractory valve plates and being connected together by at least one connecting rod.

6. The sliding gate valve of claim 1, wherein said plurality of mounting components are removably arranged in said housing portion and adapted to be removed from said housing portion as a unit including said spring element.

7. The sliding gate valve of claim 1, wherein said slider unit includes a guide track on each of said two opposite sides of said refractory valve plates, said guide element of each mounting component comprising sliding rollers for riding on a respective one of said guide tracks.

8. The sliding gate valve of claim 1, wherein said slider unit is operable to be mounted by a hinge about a pivotal axis on a side of said housing portion when said slider unit is released from said housing portion so as to be positioned in a swung-out position.

9. The sliding gate valve of claim 8, wherein said slider unit and said housing portion are arranged such that when said slider unit is moved so as to be released from said housing unit, a hinge member of said slider unit engages a hinge peg on said housing portion so as to form said hinge and so as to pivotally connect said slider unit to said housing portion.

10. The sliding gate valve of claim 8, further comprising a drive element having a push rod, wherein said slider unit is coupled to said push rod by a coupling adapted to automatically uncouple when said slider unit is moved to the swung-out position.

11. The sliding gate valve of claim 1, wherein said guide element of each mounting component includes a shaft and a rotatable sliding roller mounted on said shaft for riding on a respective one of said guide tracks.

12. The sliding gate valve of claim 1, wherein said housing portion and said slider unit are arranged parallel and adjacent to each other when the sliding gate valve is in an operational state.

13. The sliding gate valve of claim 1, wherein each side of said slider unit has a T-shaped groove extending along a direction of movement of said slider unit, said guide tracks of said slider unit being formed in said T-shaped groove so as to guide said guide element of each of said mounting components, said guide element comprising two sliding rollers arranged symmetrically with respect to a connecting element of said mounting component.

14. The sliding gate valve of claim 13, wherein each T-shaped groove has a diverging opening located at a middle portion and an end portion of said T-shaped groove with respect to a longitudinal axis of said T-shaped groove, each diverging opening being adapted so as to allow said guide element and said connecting element of said mounting component to pass therethrough.

15. A sliding gate valve to be mounted to a container for containing molten metal, comprising:

a housing portion to be secured to the container and having guide tracks;

a slider unit mounted to said housing portion;

a first refractory valve plate and a second refractory valve plate inserted between said housing portion and said slider unit and operable to open and close the sliding gate valve; and a plurality of mounting components aligned perpendicular to said slider unit so as to mount said slider unit to said housing portion such that said slider unit is slidable with respect to said housing portion, each of said mounting components having:

a first end secured to said slider unit;

spring elements for pressing said first refractory valve plate and said second refractory valve plate against each other;

a second end opposite said first end; and a guide element on said second end for riding on a respective one of said guide tracks of said housing portion, said mounting components being arranged such that two guide elements are positioned on each of two opposite sides of said refractory valve plates;

wherein said slider unit is operable to be moved so as to position said guide elements at a location whereat a height of said guide tracks is lower than a height of a remaining portion of said guide tracks so as to relax said spring elements to allow release of said slider unit.

16. The sliding gate valve of claim 15, wherein said plurality of mounting components comprise two mounting components positioned on each of said two opposite sides of said refractory valve plates, each of said mounting components having an elongated connecting element extending perpendicular to a longitudinal axis of said housing portion and said sliding unit, said guide element being arranged on an end of said connecting element.

17. The sliding gate valve of claim 16, wherein each spring element comprises a compression spring element, each connecting element being mounted in said sliding unit so as to be operable to move in an axial direction of said connecting element and so as to be biased by said spring elements so as to press said first refractory valve plate and said second refractory valve plate against each other.

18. The sliding gate valve of claim 16, wherein said two mounting components positioned on each of said two opposite sides of said refractory valve plates are arranged in said slider unit so as to be symmetrical with respect to an outlet opening of the container.

19. The sliding gate valve of claim 15, wherein said plurality of mounting components comprise two mounting components positioned on one side of said refractory valve plates and being connected together by at least one connecting rod.

20. The sliding gate valve of claim 15, wherein said plurality of mounting components are removably arranged in said slider unit and adapted to be removed from said slider unit as a unit including said spring element.

21. The sliding gate valve of claim 15, wherein said housing portion includes a guide track on each of said two opposite sides of said refractory valve plates, said guide element of each mounting component comprising sliding rollers for riding on a respective one of said guide tracks.

22. The sliding gate valve of claim 15, wherein said slider unit is operable to be mounted by a hinge about a pivotal axis on a side of said housing portion when said slider unit is released from said housing portion so as to be positioned in a swung-out position.

23. The sliding gate valve of claim 22, wherein said slider unit and said housing portion are arranged such that when said slider unit is moved so as to be released from said housing unit, a hinge member of said slider unit engages a hinge peg on said housing portion so as to form said hinge and so as to pivotally connect said slider unit to said housing portion.

24. The sliding gate valve of claim 22, further comprising a drive element having a push rod, wherein said slider unit is coupled to said push rod by a coupling adapted to automatically uncouple when said slider unit is moved to the swung-out position.

25. The sliding gate valve of claim 15, wherein said guide element of each mounting component includes a shaft and a rotatable sliding roller mounted on said shaft for rolling on a respective one of said guide tracks.

26. The sliding gate valve of claim 15, wherein said housing portion and said slider unit are arranged parallel and adjacent to each other when the sliding gate valve is in an operational state.

* * * * *